US010173184B2

(12) United States Patent
Chong

(10) Patent No.: US 10,173,184 B2
(45) Date of Patent: Jan. 8, 2019

(54) BLENDER FOR MIXING AND PUMPING SOLIDS AND FLUIDS AND METHOD OF USE THEREOF

(71) Applicant: Schlumberger Technology Corporation, Sugar Land, TX (US)

(72) Inventor: Jonathan Wun Shiung Chong, Sugar Land, TX (US)

(73) Assignee: Schlumberger Technology Corporation, Sugar Land, TX (US)

( * ) Notice: Subject to any disclaimer, the term of this patent is extended or adjusted under 35 U.S.C. 154(b) by 374 days.

(21) Appl. No.: 14/668,032

(22) Filed: Mar. 25, 2015

(65) Prior Publication Data

US 2016/0279585 A1 Sep. 29, 2016

(51) Int. Cl.

| | |
|---|---|
| ***B01F 7/00*** | (2006.01) |
| ***B01F 7/16*** | (2006.01) |
| ***B01F 3/12*** | (2006.01) |

(52) U.S. Cl.

CPC ..... *B01F 7/00341* (2013.01); *B01F 3/12* (2013.01); *B01F 3/1207* (2013.01); *B01F 3/1221* (2013.01); *B01F 7/00241* (2013.01); *B01F 7/1645* (2013.01)

(58) Field of Classification Search

CPC .. B01F 3/1221; B01F 7/00341; B01F 7/1645; B01F 7/00541; B01F 7/005; B01F 7/0025

See application file for complete search history.

(56) References Cited

U.S. PATENT DOCUMENTS

| | | | | |
|---|---|---|---|---|
| 2,346,366 A * | 4/1944 | Durdin | B01F 3/04773 | 210/197 |
| 3,147,957 A * | 9/1964 | Martin | B01F 7/00241 | 159/4.2 |
| 3,252,690 A * | 5/1966 | Martin | B01F 7/00241 | 366/265 |
| 3,326,536 A * | 6/1967 | Zingg | B01F 5/22 | 366/17 |
| 3,423,075 A * | 1/1969 | Munjee | B01F 5/16 | 366/181.1 |

(Continued)

OTHER PUBLICATIONS

WO 2016/153883, corresponding to PCT/US2016/022733, Drawings figures and search report Form PCT/ISA/2010, dated Jun. 24, 2016, 9 pages (Year: 2016).*

(Continued)

*Primary Examiner* — Tony G Soohoo

(74) *Attorney, Agent, or Firm* — Michael L. Flynn; Rachel E. Greene; Robin Nava

(57) ABSTRACT

An apparatus and method are disclosed for mixing and pumping solids and fluids and includes use of a blender including: a casing defining a cavity; a drive shaft extending through a casing opening into the cavity; a slinger having an outer edge, a center, a bottom slinger surface, a top slinger surface, and a plurality of slinger blades extending upwardly from the top slinger surface, wherein the slinger is attached to the drive shaft, and wherein the height of the top slinger surface above the bottom slinger surface continuously increases from the outer edge to the center; and an impeller having a bottom impeller surface and a plurality of impeller blades extending downwardly from the bottom impeller surface, wherein the impeller is positioned below the slinger and is attached to the drive shaft.

23 Claims, 8 Drawing Sheets

(56) References Cited

U.S. PATENT DOCUMENTS 3,470,092 A * 9/1969 Bernard ..... C02F 3/12 210/142
3,797,809 A * 3/1974 Sydnor, Jr. ..... B01F 3/04773 261/120
3,904,714 A * 9/1975 Rooney ..... B01F 3/0478 210/219
4,018,859 A * 4/1977 Muller ..... B01F 3/04539 261/151
4,066,722 A * 1/1978 Pietruszewski ..... B01F 3/04241 210/219
4,239,396 A * 12/1980 Arribau ..... B01F 5/225 366/170.3
4,439,042 A * 3/1984 Bertoglio ..... B01F 3/1221 366/154.2
4,453,829 A * 6/1984 Althouse, III ..... B01F 5/226 366/13
4,460,276 A * 7/1984 Arribau ..... B01F 5/16 366/13
4,468,358 A * 8/1984 Haegeman ..... B01D 19/0052 210/219
4,522,766 A * 6/1985 Sunada ..... B01F 3/0478 261/91
4,614,435 A * 9/1986 McIntire ..... B01F 5/226 366/164.6
4,663,055 A * 5/1987 Ling ..... B01F 3/0853 210/198.1
4,664,530 A * 5/1987 Kurome ..... A47J 43/046 366/205
4,671,665 A 6/1987 McIntire et al.
4,808,004 A * 2/1989 McIntire ..... B01F 5/221 366/155.1
4,834,542 A * 5/1989 Sherwood ..... B01F 7/1625 366/136
4,913,555 A * 4/1990 Maeda ..... A23G 9/12 261/DIG. 16
5,149,195 A * 9/1992 Lofgren ..... B01F 15/00824 366/265
5,322,357 A * 6/1994 Mazer ..... B01F 5/16 366/181.1
5,904,419 A * 5/1999 Arribau ..... B01F 3/1221 366/167.2
6,019,498 A * 2/2000 Hamada ..... B01F 3/1221 241/46.017
6,193,402 B1 2/2001 Grimland et al.
7,163,198 B2 * 1/2007 Hofken ..... B01F 3/04531 261/91
7,334,937 B2 2/2008 Arribau et al.
7,967,500 B2 * 6/2011 Arribau ..... B01F 3/1221 366/164.6
8,434,744 B2 * 5/2013 Hoefken ..... B01F 3/04531 261/93
8,459,863 B2 * 6/2013 Hoefken ..... B01F 3/04539 366/331
8,534,907 B2 * 9/2013 Yum ..... B01F 1/00 366/165.3
8,545,091 B1 * 10/2013 Arribau ..... B01F 5/22 366/167.2
9,375,691 B2 * 6/2016 Stegemoeller ..... B01F 15/0227
2004/0213080 A1 * 10/2004 Schertenleib ..... B01F 3/1221 366/171.1
2004/0218465 A1 * 11/2004 Arribau ..... B01F 3/1221 366/164.6
2006/0171804 A1 * 8/2006 Brown ..... F04D 29/544 415/220
2009/0127213 A1 * 5/2009 Hoefken ..... B01F 3/04773 210/800
2010/0046323 A1 * 2/2010 Tien ..... B01F 13/0818 366/274
2010/0086410 A1 * 4/2010 Sykora ..... B01F 3/1221 416/223 R
2010/0182869 A1 * 7/2010 Hoefken ..... B01F 3/04531 366/343
2010/0188926 A1 * 7/2010 Stegemoeller ..... B01F 3/1221 366/137
2010/0196165 A1 * 8/2010 Hoefken ..... B01F 3/04531 416/223 R
2014/0010038 A1 * 1/2014 Iwako ..... B01F 3/1221 366/91
2014/0078856 A1 * 3/2014 Arribau ..... B01F 5/22 366/177.1
2015/0238912 A1 * 8/2015 Luharuka ..... B01F 3/1221 366/182.2
2015/0238913 A1 * 8/2015 Luharuka ..... B01F 5/106 366/138
2015/0238914 A1 * 8/2015 Luharuka ..... B01F 5/0647 366/154.1
2016/0121285 A1 * 5/2016 Pham ..... B01F 15/0235 366/168.1
2016/0216171 A1 * 7/2016 Moakler ..... G01M 1/22
2016/0279585 A1 * 9/2016 Chong ..... B01F 3/12
2016/0320347 A1 * 11/2016 Moakler ..... G01N 29/14

OTHER PUBLICATIONS

International Written opinon Form PCT/ISA/237 and cover sheet PCT/ISA/373 issued in International Patent Application No. PCT/US2016/022733 dated Jun. 23, 2016; 6 pages (Year: 2016).*
International Search report Form PCT/ISA/210 and PCT/ISA/220 issued in International Patent Application No. PCT/US2016/022733 dated Jun. 24, 2016; 3 pages (Year: 2016).*

* cited by examiner

BLENDER FOR MIXING AND PUMPING SOLIDS AND FLUIDS AND METHOD OF USE THEREOF

FIELD

The disclosure generally relates to an apparatus and methods for mixing and pumping solids and fluids, and more particularly, but not by way of limitation, apparatus and methods for mixing and pumping solids and fluids including use of a slinger having a top surface with a convex or spline type shape.

BACKGROUND

The statements in this section merely provide background information related to the disclosure and may not constitute prior art.

In the oil and gas drilling and production industry, viscous aqueous fluids are commonly used in treating subterranean wells, as well as carrier fluids. Such fluids may be used as fracturing fluids, acidizing fluids, and high-density completion fluids. In an operation known as well fracturing, such fluids are used to initiate and propagate underground fractures for increasing petroleum productivity.

During fracturing operations, fluids pumped into the subterranean formation can include solids such as proppant mixed with a fluid such as an aqueous gel. Such proppant-containing fluids are mixed in a blender including a slinger and a pump impeller, each attached to a drive shaft and enclosed within a casing. In recent years, fluids containing elevated levels of solids have been used resulting in substantial increases in wear and tear on the blender internals and resulting in decreased mixing and pumping efficiency.

Therefore, there is a need for efficient apparatus and methods useful for mixing and pumping solids and fluids with decreased wear and tear, such need met, at least in part, by the following disclosure.

SUMMARY

In an embodiment, a blender is disclosed including: a casing defining a cavity and having a top casing surface and a bottom casing surface; a drive shaft extending through a casing opening into the cavity; a slinger having an outer edge, a center, a bottom slinger surface facing the bottom casing surface, a top slinger surface facing the top casing surface, and a plurality of slinger blades extending upwardly from the top slinger surface, wherein the slinger is attached to the drive shaft, and wherein the height of the top slinger surface above the bottom slinger surface continuously increases from the outer edge to the center; and an impeller having a bottom impeller surface facing the bottom casing surface and a plurality of impeller blades extending downwardly from the bottom impeller surface, wherein the impeller is positioned below the slinger and is attached to the drive shaft.

In accordance with another embodiment, a slinger and impeller assembly is disclosed and includes: a drive shaft; a slinger having an outer edge, a center, a bottom slinger surface, a top slinger surface, and a plurality of slinger blades extending upwardly from the top slinger surface, wherein the slinger is attached to the drive shaft, and wherein the height of the top slinger surface above the bottom slinger surface continuously increases from the outer edge to the center; and an impeller having a bottom impeller surface and a plurality of impeller blades extending downwardly from the bottom impeller surface, wherein the impeller is positioned below the slinger and is attached to the drive shaft.

In accordance with another embodiment, a method is disclosed and includes utilizing the above described blender by introducing a proppant into a top casing opening defined by the top casing surface for contact with the top slinger surface, introducing a fluid to the impeller, mixing the proppant and the fluid to form a mixture, and discharging the mixture through an outlet of the blender.

BRIEF DESCRIPTION OF THE DRAWINGS

Certain embodiments of the disclosure will hereafter be described with reference to the accompanying drawings, wherein like reference numerals denote like elements. It should be understood, however, that the accompanying figures illustrate the various implementations described herein and are not meant to limit the scope of various technologies described herein.

DETAILED DESCRIPTION

In the following description, numerous details are set forth to provide an understanding of some embodiments of the present disclosure. However, it will be understood by those of ordinary skill in the art that the system and/or methodology may be practiced without these details and that numerous variations or modifications from the described embodiments may be possible.

Unless expressly stated to the contrary, "or" refers to an inclusive or and not to an exclusive or. For example, a condition A or B is satisfied by anyone of the following: A is true (or present) and B is false (or not present), A is false (or not present) and B is true (or present), and both A and B are true (or present).

In addition, use of the "a" or "an" are employed to describe elements and components of the embodiments herein. This is done merely for convenience and to give a general sense of the inventive concept. This description should be read to include one or at least one and the singular also includes the plural unless otherwise stated.

The terminology and phraseology used herein is for descriptive purposes and should not be construed as limiting in scope. Language such as "including," "comprising," "having," "containing," or "involving," and variations thereof, is intended to be broad and encompass the subject matter listed thereafter, equivalents, and additional subject matter not recited.

Finally, as used herein any references to "one embodiment" or "an embodiment" means that a particular element, feature, structure, or characteristic described in connection with the embodiment is included in at least one embodiment. The appearances of the phrase "in one embodiment" in various places in the specification are not necessarily referring to the same embodiment.

Some aspects of the disclosure relate to apparatus for, and methods for, mixing solids and fluids.

Figure 1:
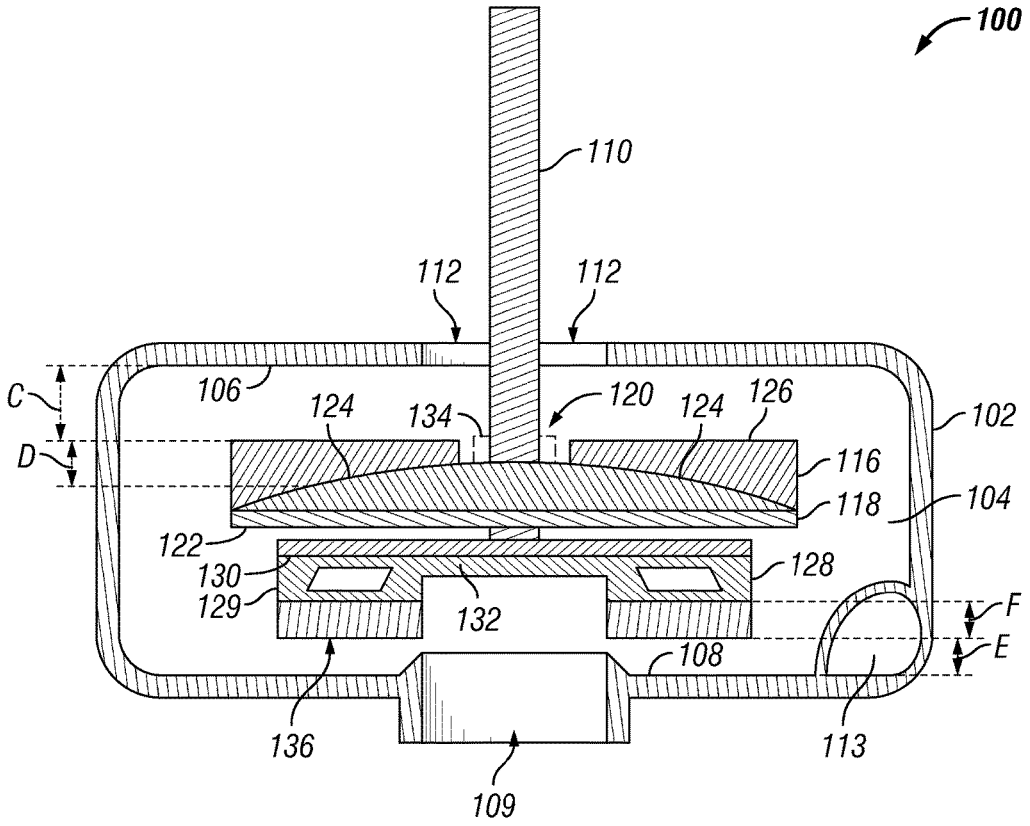
FIG. 1 illustrates some embodiments in accordance with the disclosure in side view and cross section.
Figure 2:
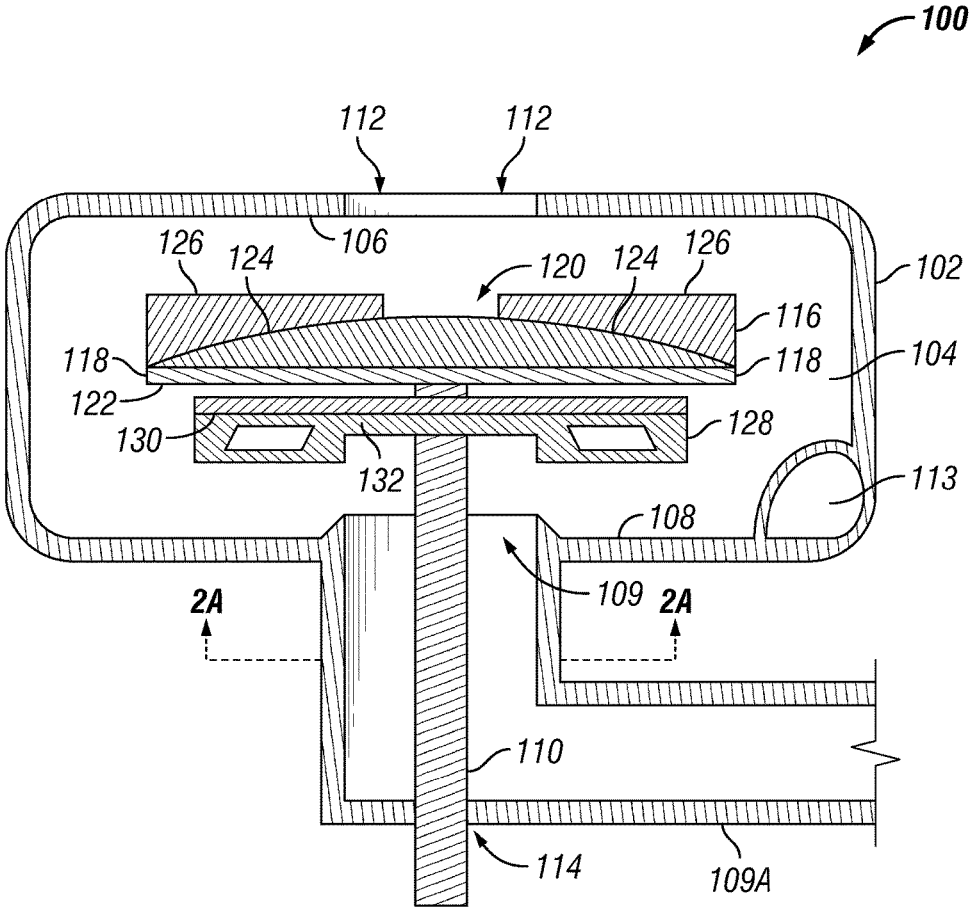
FIG. 2 illustrates some embodiments in accordance with the disclosure in side view and cross section.
Figure 2A:
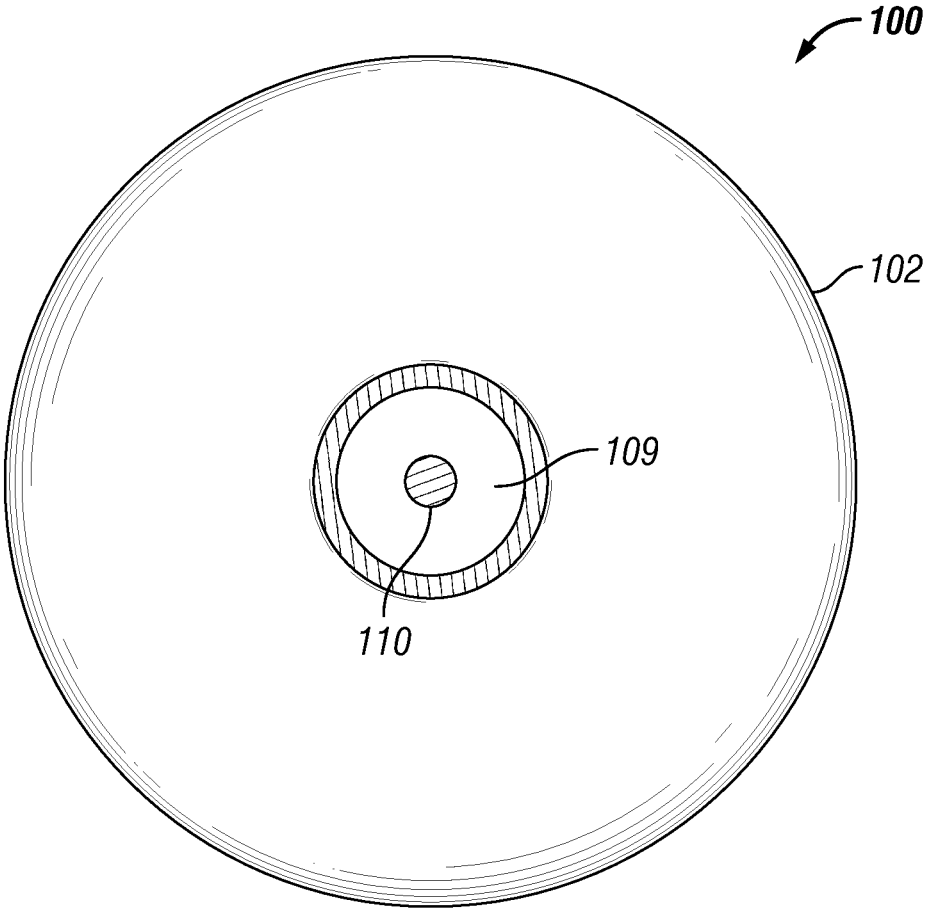
FIG. 2A depicts a bottom plan view of blender 100 of FIG. 2 in accordance with some embodiments of the disclosure.

With reference to FIGS. 1 and 2, in some embodiments, the blender 100 can comprise, consist of, or consist essentially of a: i) casing 102 defining a cavity 104 and having a top casing surface 106 and a bottom casing surface 108, a fluid entry 109 defined by bottom casing surface 108, a top casing opening 112 defined by top casing surface 106, and a slurry discharge 113; ii) a drive shaft 110 extending through a casing opening into the cavity 104 (shown as drive shaft 110 extending through top casing opening 112 in FIG. 1, and shown in FIG. 2 as drive shaft 110 extending through opening 114 defined by a fluid inlet conduit 109A connected in fluid flow communication with bottom casing opening 109); iii) a slinger 116 having an outer edge 118, a center 120, a bottom slinger surface 122 facing the bottom casing surface 108, a top slinger surface 124 facing the top casing surface 106, and a plurality of slinger blades 126 extending upwardly from the top slinger surface 124, wherein the slinger 116 is attached to the drive shaft 110, and wherein the height of the top slinger surface 124 above the bottom slinger surface 122 continuously increases from the outer edge 118 to the center 120; and iv) an impeller 128 having a bottom impeller surface 130 facing the bottom casing surface 108 and a plurality of impeller blades 132 extending downwardly from the bottom impeller surface 130, wherein the impeller 128 is positioned below the slinger 116 and is attached to the drive shaft 110. When the drive shaft 110 extends through the opening 114, as shown in FIG. 2 and FIG. 2A, which is a bottom view of blender 100, the drive shaft 110 is in sealing engagement with fluid inlet conduit 109A while still allowing free rotation of the drive shaft 110. The slinger blades 126 of the slinger 116 can be open to the top casing surface 106 as shown in FIGS. 1 and 2, or can be at least partially closed off to the top casing surface 106 (not shown, but with a configuration similar to the closed impeller shown in FIG. 6C). The slinger blades 126 are shown having an upper surface parallel to the top casing surface 106, but can have any configuration between parallel to the top slinger surface 124 up to parallel to the top casing surface 106.

Figure 3:
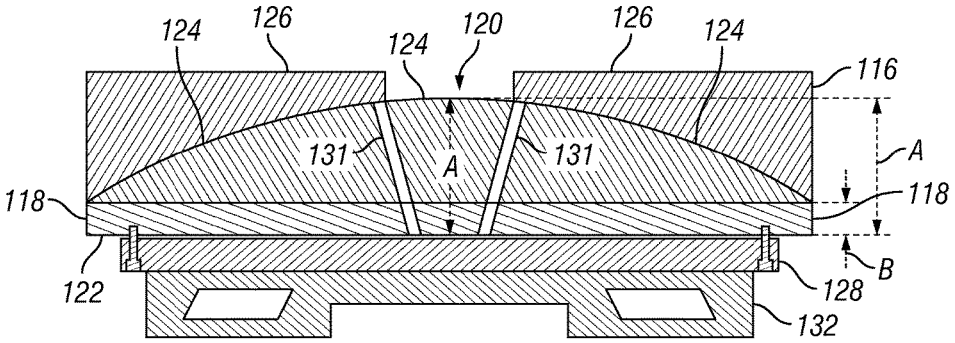
FIG. 3 illustrates some embodiments in accordance with the disclosure in side view.

In accordance with an embodiment, FIG. 3 shows a side view of the slinger 116 and impeller 128 wherein the impeller is secured to the slinger. In accordance with an embodiment, the top slinger surface 124 can have a convex shape as shown in FIGS. 1-3. With reference to FIG. 3, A is the height of the top slinger surface 124 above the bottom slinger surface 122 at or near the center 120 of the slinger 116; B is the height of the top slinger surface 124 above the bottom slinger surface 122 at or near the outer edge 118 of the slinger 116; and the ratio of A to B is up to about 20:1 or up to about 10:1 or up to about 5:1. In accordance with an embodiment, the slinger 116 can further comprise breathing holes 131 providing passage ways for entrained air to pass out of the top casing opening 112 (as shown in FIGS. 1 and 2) of blender 100. The term "at or near" for the "center 120" and the "outer edge 118", as used herein, can range up to a distance of 5% or 10% of the radius of the slinger 116.

Figure 4:
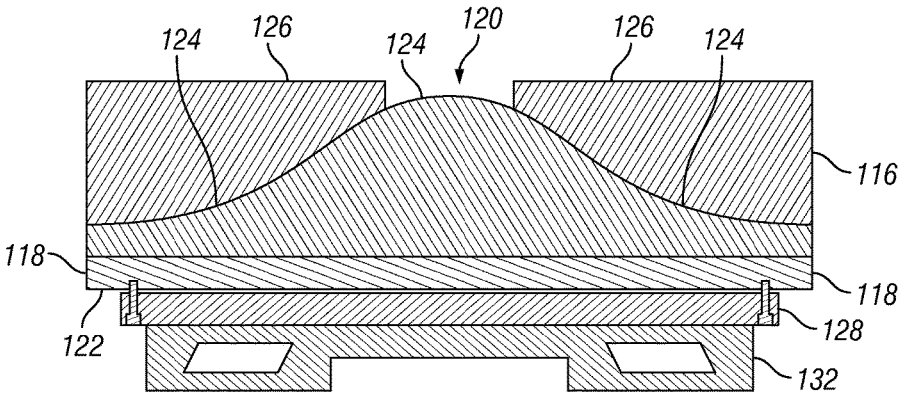
FIG. 4 illustrates some embodiments in accordance with the disclosure in side view.

In accordance with an embodiment, FIG. 4 shows a side view of the slinger 116 and impeller 128 wherein the top slinger surface 124 is depicted as having a spline-type shape.

In accordance with an embodiment, the area of the top casing opening 112 in the top casing surface 106 can be from about 15% to about 60% or from about 25% to about 50% or from about 35% to about 40% of the total area of the top casing surface 106.

In accordance with an embodiment, when the drive shaft 110 extends downwardly through the top casing opening 112 into the cavity as shown in FIG. 1, the blender can further comprise a hub 134 attached to the top slinger surface 124; wherein the drive shaft 110 can be attached to the hub 134 and the impeller 128 can be attached to the slinger 116 (as shown in FIGS. 3 and 4).

Figure 5:
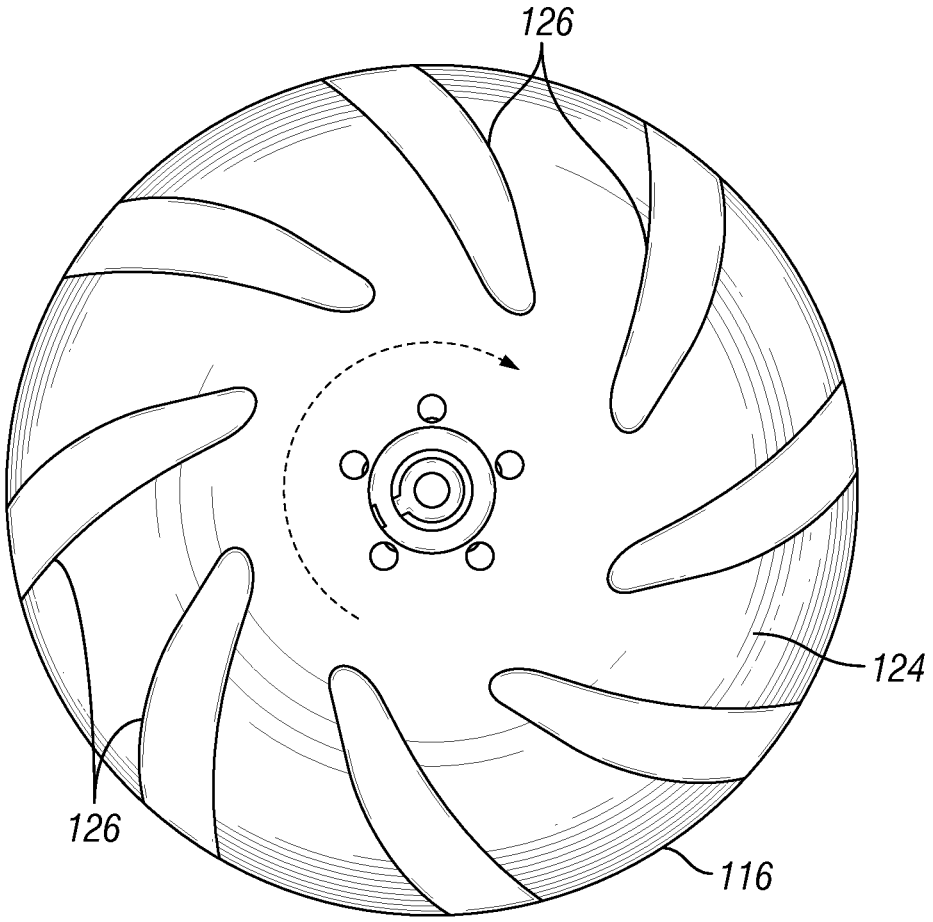
FIG. 5 illustrates some embodiments in accordance with the disclosure in top view.

In accordance with an embodiment as shown in FIG. 5, which is a top view of slinger 116, the plurality of slinger blades 126 can each have an inner end which is substantially tangential to an inner circumference (indicated by the arrow) of the top slinger surface 124.

In accordance with an embodiment, and with reference to FIG. 1, C is a vertical distance from any point along the top of the plurality of slinger blades 126 to the top casing surface 106 and D is a distance at a corresponding horizontal point from the top of the plurality of slinger blades 126 to the top slinger surface 124. FIG. 1 shows the distances at one particular point, but it should be understood that the distances C and D can be measured at any point along the top of the plurality of slinger blades 126. In accordance with an embodiment, the ratio of C to D can be between about 0.1:1 to about 2:1 or from about 0.1:1 to about 1.5:1 or from about 0.5:1 to about 1:1.

Figure 6C:
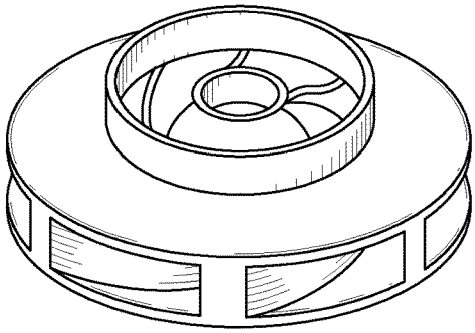
FIG. 6C depicts a closed impeller in accordance with some embodiments of the disclosure.
Figure 6B:
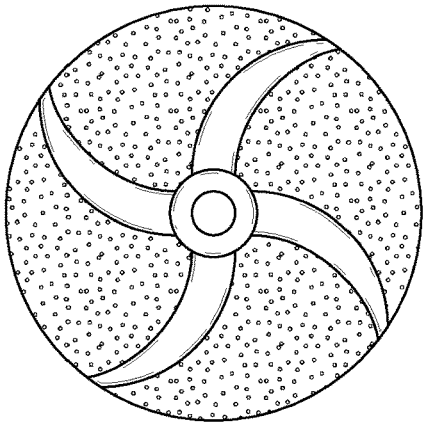
FIG. 6B depicts a semi-open impeller in accordance with some embodiments of the disclosure.
Figure 6A:
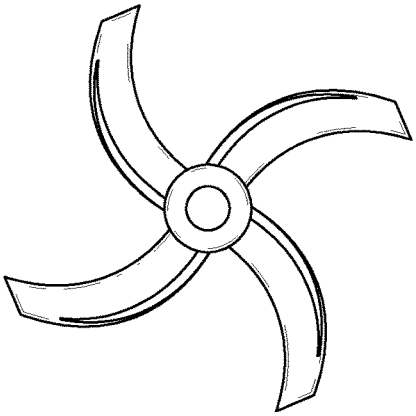
FIG. 6A depicts an open impeller in accordance with some embodiments of the disclosure.

In accordance with an embodiment, and with reference to FIGS. 6*a*-6*c*, the impeller 128 can be selected from the group consisting of: an open impeller (depicted in FIG. 6*a*), a semi-open impeller (depicted in FIG. 6*b*), and a closed impeller (depicted in FIG. 6*c*). Open impellers comprise blades attached to a drive shaft, semi-open impellers are constructed with a circular plate (the web) attached to one side of the blades, and enclosed impellers have circular plates attached to both sides of the blades. Enclosed impellers can also be referred to as shrouded impellers.

Figure 7:
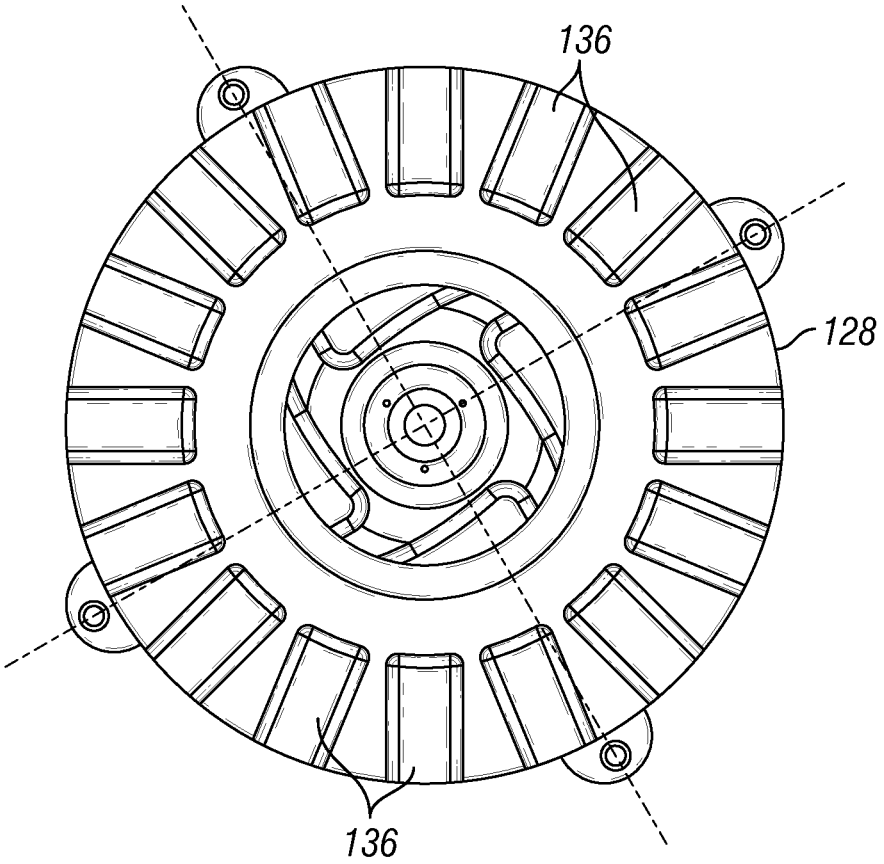
FIG. 7 illustrates some embodiments in accordance with the disclosure in bottom view.

In accordance with an embodiment, and as shown in FIG. 7 (which is a bottom view of impeller 128) and FIG. 1, the impeller 128 can further comprise a bottom plate 129 attached to the bottom of the impeller blades 132, and a plurality of pump out vanes 136 extending from the bottom plate 129 toward the bottom casing surface 108; E is a distance from the bottom surface of the pump out vanes 136 to the bottom casing surface 108; F is a distance from the bottom surface of the pump out vanes 136 to the bottom plate 129; and the ratio of E to F is at most about 2.5:1 or at most 2.0:1 or at most 1.5:1.

Figure 8:
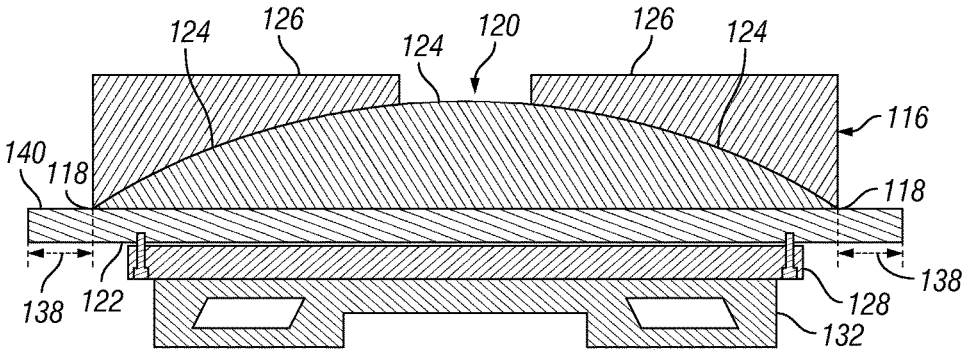
FIG. 8 illustrates some embodiments in accordance with the disclosure in side view.
Figure 9:
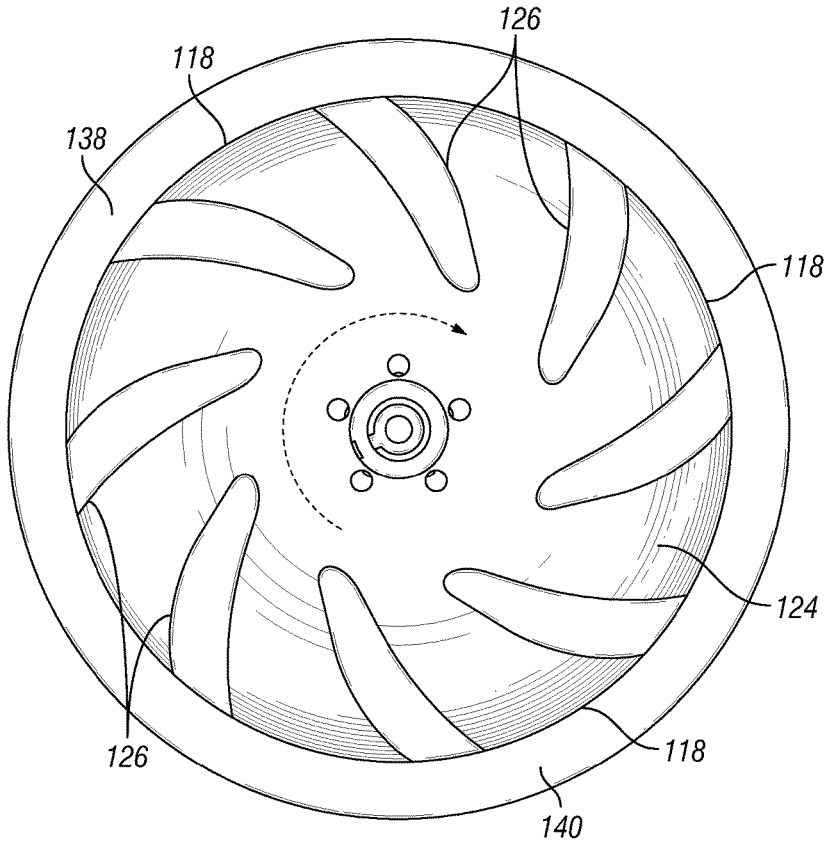
FIG. 9 illustrates some embodiments in accordance with the disclosure in top view.

In accordance with an embodiment, and with reference to FIG. 8 which is a side view the slinger 116 and the impeller 128, and FIG. 9 which is a top view of the slinger 116 shown in FIG. 8, the slinger 116 can further comprise a substantially flat edge 138 extending radially from the outer edge 118 and comprising a substantially flat edge top surface 140, wherein the height of the substantially flat edge top surface 140 above the bottom slinger surface 122 is within 5% or 3% or 2% of the height of the top slinger surface 124 above the bottom slinger surface 122 at the outer edge 118; and wherein the width of the substantially flat edge 138 is at most 50% or at most 35% or at most 25% of the radius of the slinger 116.

In accordance with an embodiment, and with reference to either FIG. 1 or FIG. 2, a method for mixing a solid with a fluid can comprise, consist of, or consist essentially of: utilizing a blender 100 in accordance with any of the above described embodiments; introducing a solid into the top casing opening 112; introducing a fluid to the impeller 128 through bottom casing opening 109; mixing the solid with the fluid thereby forming a mixture; and discharging the mixture from the blender through slurry discharge 113. In accordance with an embodiment, the solid can comprise a solid component selected from the group consisting of a proppant, a powder, a fiber, and combinations thereof; and the fluid can comprise a fluid component selected from the group consisting of water, a gel, and combinations thereof.

With reference to FIGS. 1-3, and in accordance with an embodiment, entrained air in the mixture can be drawn through the breathing holes 131 depicted in FIG. 3 and escape the blender 100 through the top casing opening 112 depicted in FIGS. 1 and 2.

The foregoing description of the embodiments has been provided for purposes of illustration and description. Example embodiments are provided so that this disclosure will be thorough, and will fully convey the scope to those who are skilled in the art. Numerous specific details are set forth such as examples of specific components, devices, and methods, to provide a thorough understanding of embodiments of the disclosure, but are not intended to be exhaustive or to limit the disclosure. Individual elements or features of a particular embodiment are generally not limited to that particular embodiment, but, where applicable, are interchangeable and can be used in a selected embodiment, even if not specifically shown or described. The same may also be varied in many ways. Such variations are not to be regarded as a departure from the disclosure, and all such modifications are intended to be included within the scope of the disclosure.

It will be apparent to those skilled in the art that specific details need not be employed, that example embodiments may be embodied in many different forms and that neither should be construed to limit the scope of the disclosure. In some example embodiments, well-known processes, well-known device structures, and well-known technologies are not described in detail. Further, it will be readily apparent to those of skill in the art that in the design, manufacture, and operation of apparatus to achieve that described in the disclosure, variations in apparatus design, construction, condition, erosion of components, gaps between components may be present, for example.

Although the terms first, second, third, etc. may be used herein to describe various elements, components, regions, layers and/or sections, these elements, components, regions, layers and/or sections should not be limited by these terms. These terms may be only used to distinguish one element, component, region, layer or section from another region, layer or section. Terms such as "first," "second," and other numerical terms when used herein do not imply a sequence or order unless clearly indicated by the context. Thus, a first element, component, region, layer or section discussed below could be termed a second element, component, region, layer or section without departing from the teachings of the example embodiments.

Spatially relative terms, such as "inner," "outer", "center", "beneath," "below," "lower," "above," "upper," "top," "bottom" and the like, may be used herein for ease of description to describe one element or feature's relationship to another element(s) or feature(s) as illustrated in the figures. Spatially relative terms may be intended to encompass different orientations of the device in use or operation in addition to the orientation depicted in the figures. For example, if the device in the figures is turned over, elements described as "below" or "beneath" other elements or features would then be oriented "above" the other elements or features. Thus, the example term "below" can encompass both an orientation of above and below. The device may be otherwise oriented (rotated 90 degrees or at other orientations) and the spatially relative descriptors used herein interpreted accordingly.

Although various embodiments have been described with respect to enabling disclosures, it is to be understood the invention is not limited to the disclosed embodiments. Variations and modifications that would occur to one of skill in the art upon reading the specification are also within the scope of the invention, which is defined in the appended claims.

What is claimed is:

1. A blender comprising:

a casing defining a cavity and having a top casing surface and a bottom casing surface;

a drive shaft extending through a casing opening into the cavity;

a slinger having an outer edge, a center, a bottom slinger surface facing the bottom casing surface, a top slinger surface facing the top casing surface, and a plurality of slinger blades extending upwardly from the top slinger surface, wherein the slinger is attached to the drive shaft, and wherein the height of the top slinger surface above the bottom slinger surface continuously increases from the outer edge to the center; and an impeller having a bottom impeller surface facing the bottom casing surface and a plurality of impeller blades extending downwardly from the bottom impeller surface, wherein the impeller is positioned below the slinger and is attached to the drive shaft.

2. The blender of claim 1 wherein A is the height of the top slinger surface above the bottom slinger surface at or near the center of the slinger; B is the height of the top slinger surface above the bottom slinger surface at or near the outer edge of the slinger; and the ratio of A to B is up to about 20:1.

3. The blender of claim 1 wherein the drive shaft extends upwardly through a bottom casing opening defined by the bottom casing surface into the cavity.

4. The blender of claim 3 wherein the top casing surface defines a top casing opening.

5. The blender of claim 4 wherein the area of the top casing opening in the top casing surface is from about 15% to about 60% of the total area of the top casing surface.

6. The blender of claim 1 wherein the top casing surface defines a top casing opening, and wherein the drive shaft extends downwardly through the top casing opening into the cavity.

7. The blender of claim 6 wherein the area of the top casing opening in the top casing surface is from about 15% to about 60% of the total area of the top casing surface.

8. The blender of claim 1 wherein the top slinger surface has a convex shape.

9. The blender of claim 1 wherein the top slinger surface has a spline-type shape.

10. The blender of claim 1 wherein the plurality of slinger blades each have an inner end which is substantially tangential to an inner circumference of the top slinger surface.

11. The blender of claim 1 wherein C is a distance from the top of the plurality of slinger blades to the top casing surface; D is a distance from the top of the plurality of slinger blades to the top slinger surface; and the ratio of C to D is between about 0.1:1 to about 2:1.

12. The blender of claim 1 wherein the impeller further comprises a bottom plate attached to the bottom of the impeller blades, and a plurality of pump out vanes extending from the bottom plate toward the bottom casing surface; E is a distance from the bottom surface of the pump out vanes to the bottom casing surface; F is a distance from the bottom surface of the pump out vanes to the bottom plate; and the ratio of E to F is at most about 1.5:1.

13. The blender of claim 1 wherein the slinger further comprises a substantially flat edge extending radially from the outer edge and comprising a substantially flat edge top surface, wherein the height of the substantially flat edge top surface above the bottom slinger surface is within 5% of the height of the top slinger surface above the bottom slinger surface at the outer edge; and wherein the width of the substantially flat edge is at most 25% of the radius of the slinger.

14. The blender of claim 1 wherein the plurality of slinger blades are at least partially closed off to the top casing surface.

15. A slinger and impeller assembly comprising:

a drive shaft;

a slinger having an outer edge, a center, a bottom slinger surface, a top slinger surface, and a plurality of slinger blades extending upwardly from the top slinger surface, wherein the slinger is attached to the drive shaft, and wherein the height of the top slinger surface above the bottom slinger surface continuously increases from the outer edge to the center; and an impeller having a bottom impeller surface and a plurality of impeller blades extending downwardly from the bottom impeller surface, wherein the impeller is positioned below the slinger and is attached to the drive shaft.

16. The slinger and impeller assembly of claim 15 wherein A is the height of the top slinger surface above the bottom slinger surface at or near the center of the slinger; B is the height of the top slinger surface above the bottom slinger surface at or near the outer edge of the slinger; and the ratio of A to B is up to about 20:1.

17. The slinger and impeller assembly of claim 15 wherein the top slinger surface has a convex shape.

18. The slinger and impeller assembly of claim 15 wherein the top slinger surface has a spline-type shape.

19. The slinger and impeller assembly of claim 15 wherein the slinger further comprises a substantially flat edge extending radially from the outer edge and comprising a substantially flat edge top surface, wherein the height of the substantially flat edge top surface above the bottom slinger surface is within 5% of the height of the top slinger surface above the bottom slinger surface at the outer edge; and wherein the width of the substantially flat edge is at most 25% of the radius of the slinger.

20. A method for mixing a solid with a fluid comprising:

utilizing a blender comprising:

a casing defining a cavity and having a top casing surface and a bottom casing surface, wherein the top casing surface defines a top casing opening;

a drive shaft extending through a casing opening into the cavity;

a slinger having an outer edge, a center, a bottom slinger surface facing the bottom casing surface, a top slinger surface facing the top casing surface, and a plurality of slinger blades extending upwardly from the top slinger surface, wherein the slinger is attached to the drive shaft, and wherein the height of the top slinger surface above the bottom slinger surface continuously increases from the outer edge to the center; and an impeller having a bottom impeller surface facing the bottom casing surface and a plurality of impeller blades extending downwardly from the bottom impeller surface, wherein the impeller is positioned below the slinger and is attached to the drive shaft;

introducing a solid into the top casing opening;

introducing a fluid to the impeller through a bottom casing opening of the casing;

mixing the solid with the fluid thereby forming a mixture; and discharging the mixture from the blender.

21. The method of claim 20 wherein the solid comprises a proppant and the fluid comprises water.

22. The method of claim 20 wherein the slinger further comprises breathing holes, and wherein entrained air in the mixture is drawn through the breathing holes and escapes the blender through the top casing opening.

23. The method of claim 20 wherein the plurality of slinger blades are at least partially closed off to the top casing surface.

* * * * *